US008226171B2

(12) United States Patent
Fang

(10) Patent No.: US 8,226,171 B2
(45) Date of Patent: Jul. 24, 2012

(54) ARMREST

(76) Inventor: Tien Ching Fang, Tainan County (TW)

( * ) Notice: Subject to any disclaimer, the term of this patent is extended or adjusted under 35 U.S.C. 154(b) by 0 days.

(21) Appl. No.: 12/948,002

(22) Filed: Nov. 17, 2010

(65) Prior Publication Data

US 2012/0119557 A1 May 17, 2012

(51) Int. Cl.
*A47C 7/54* (2006.01)

(52) U.S. Cl. ..... 297/411.35; 297/411.37

(58) Field of Classification Search ..... 297/411.38, 297/411.37, 411.35, 411.2; 248/118
See application file for complete search history.

(56) References Cited

U.S. PATENT DOCUMENTS 6,502,904 B1 * 1/2003 Hansen ..... 297/411.35
6,948,775 B2 * 9/2005 Tsai ..... 297/411.37
7,201,449 B2 * 4/2007 Tsai ..... 297/411.36
7,201,450 B1 * 4/2007 Chen ..... 297/411.37
7,837,269 B2 * 11/2010 Bock ..... 297/411.35
2009/0195045 A1 * 8/2009 Lai ..... 297/411.35

* cited by examiner

*Primary Examiner* — Milton Nelson, Jr.
(74) *Attorney, Agent, or Firm* — Rosenberg, Klein & Lee

(57) ABSTRACT

An armrest includes an armrest base having a guiding groove. A support is mounted below the armrest base. The support includes a top end having a restraining plate. An engaging member includes a body having an upper portion. A slider is formed on the upper portion of the body. The slider includes two arms slideably abutting two lateral walls of the guiding groove, allowing relative sliding movement between the slider and the armrest base along the guiding groove. The engaging plate further includes an insertion plate located below the restraining plate. The engaging member can be rotatably received in the compartment of the support. The top end of the support can include an annular portion having a plurality of annularly spaced teeth in the compartment. A groove is formed between two adjacent teeth. A positioning member projects downwardly from the engaging member and is selectively engaged in one of the grooves.

7 Claims, 7 Drawing Sheets

ARMREST

BACKGROUND OF THE INVENTION

The present invention relates to an armrest and, more particularly, to an armrest for a chair.

To provide sitting comfort, a chair generally includes a seat, a backrest, and two armrests respectively on two sides of the seat. Each armrest generally includes an armrest base and an aesthetic or soft a pad on top of the armrest base. A support is mounted below the armrest base for connection with the seat or the backrest.

Conventionally, assemblage of the armrest base and the support requires complicated structure. Taiwan Utility Model No. M384589 discloses a dual-shaft swivel type chair armrest. To allow swiveling of the armrest, a complicated swivel mechanism is mounted between the armrest base and the support. The structure can be more complicated if additional functions, such as rectilinear adjustment of relative position between the armrest base and the support, are required. The assemblage is more complicated and time-consuming, increasing the costs. More materials and resources are used, which requires treatment of more wastes when the chair or armrest is discarded after it has been used for a period of time.

BRIEF SUMMARY OF THE INVENTION

An armrest according to the present invention includes an armrest base having a guiding groove with two lateral walls. A support is mounted below the armrest base. The support includes a top end having a first restraining plate. An engaging member includes a body having an upper portion. A first slider is formed on the upper portion of the body. The first slider includes two arms slideably abutting the two lateral walls of the guiding groove, allowing relative sliding movement between the first slider and the armrest base along the guiding groove. The engaging plate further includes a first insertion plate located below the first restraining plate.

Preferably, the top end of the support includes an annular portion having a compartment, and the first restraining plate is formed on an inner periphery of the compartment.

Preferably, the engaging member is rotatably received in the compartment of the support. The annular portion of the support includes a plurality of annularly spaced teeth in the compartment. A groove is formed between two adjacent teeth. The engaging member includes a first positioning member projecting downwardly therefrom. The first positioning member is selectively engaged in one of the grooves.

Preferably, the armrest base includes a bottom side having a plurality of rectilinearly spaced engaging holes. The engaging member includes a second engaging member selectively engaged in one of the plurality of engaging holes while the engaging member is moving rectilinearly relative to the support.

Preferably, the annular portion further includes a second restraining plate formed on an inner periphery of the compartment and spaced from the first restraining plate. The engaging member includes a second insertion plate. The second insertion plate is located below the second restraining plate. The first and second insertion plates are inserted to positions below the first and second restraining plate according to material resiliency and insertion angles.

Preferably, the first insertion plate is arcuate and has a length larger than the first restraining plate. A stop projects upward from each of two ends of the first insertion plate. The stops of the first insertion plate limit rotational movement of the first insertion plate.

Preferably, the second insertion plate is arcuate and has a length larger than the second restraining plate. A stop project upward from each of two ends of the second insertion plate. The stops of the second insertion plate limit rotational movement of the second insertion plate.

Preferably, the armrest includes a rear end having an opening. The opening is in communication with the guiding groove.

Preferably, the body further includes a second slider formed on the upper portion of the body and spaced from the first slider. A gap is formed between the first and second sliders. The gap forms a thin portion in the body. The thin portion of the body has a thickness allowing the body to flex. The second slider includes two arms slideably abutting the lateral walls of the guiding groove, allowing relative sliding movement between the second slider and the armrest base along the guiding groove.

The armrest base and the support of the armrest according to the present invention can be assembled with a simple mechanism, avoiding complicated assemblage. Thus, labor, time, costs, material, and resources are saved. The wastes to be treated are lesser than conventional armrests when the armrest according to the present invention is discarded.

The present invention will become clearer in light of the following detailed description of illustrative embodiments of this invention described in connection with the drawings.

DETAILED DESCRIPTION OF THE INVENTION

Figure 1:
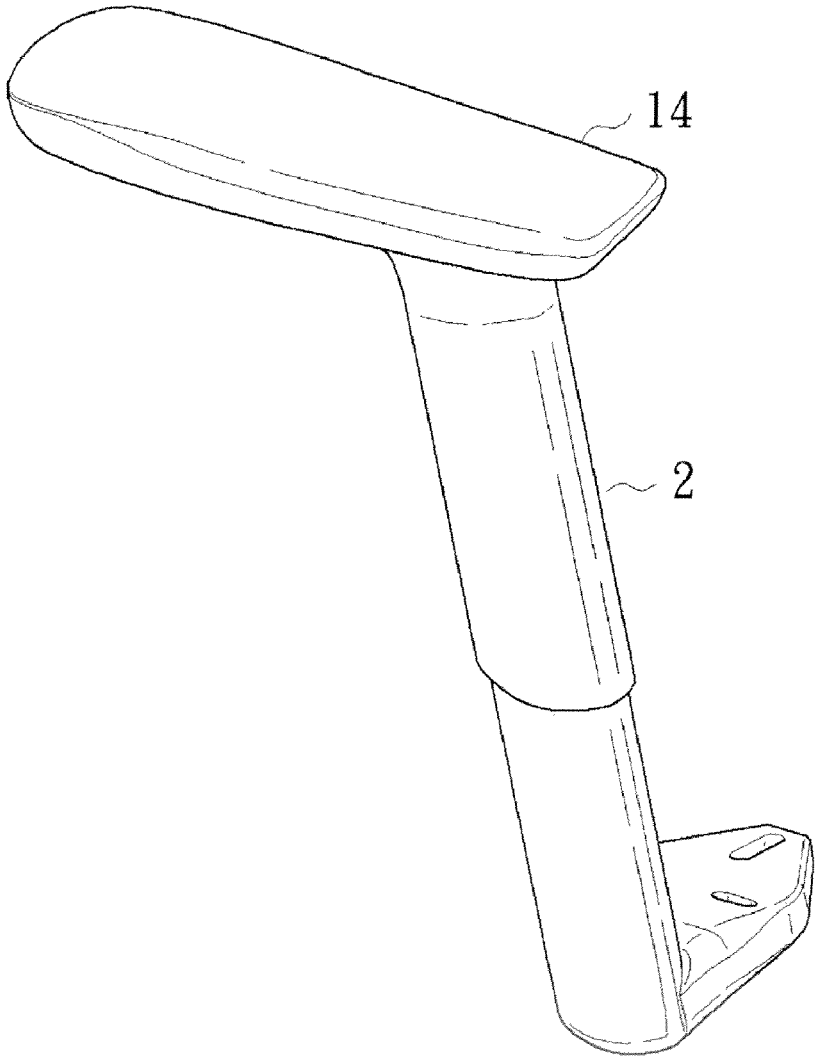
FIG. 1 shows a perspective view of an armrest according to the present invention.
Figure 2:
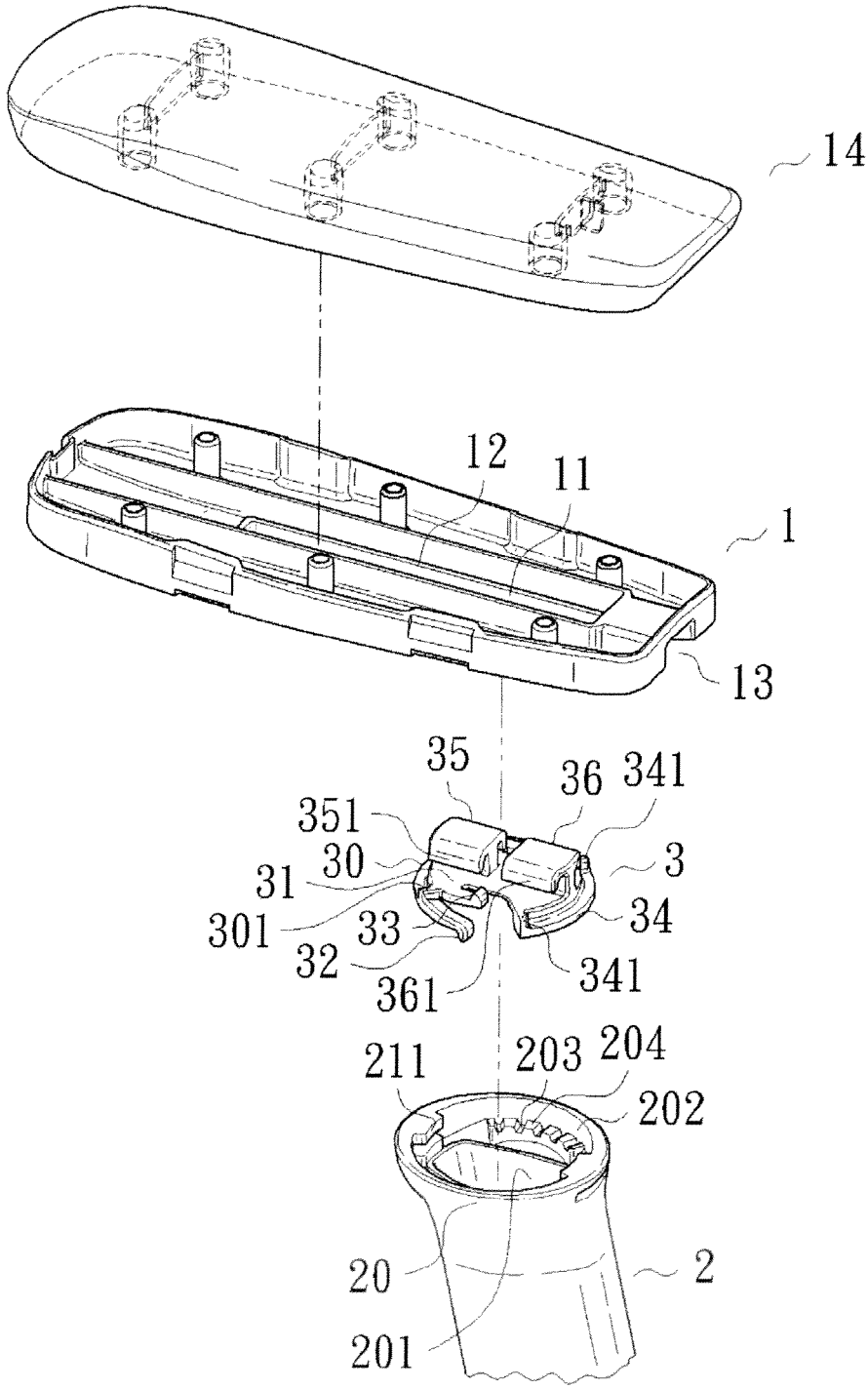
FIG. 2 shows an exploded, perspective view of the armrest of FIG. 1.

With reference to FIGS. 1 and 2, an armrest according to the present invention includes an armrest base 1, a support 2, and an engaging member 3. The armrest base 1 includes a guiding groove 11 having two lateral walls 12. An opening 13 is formed in a rear end of the armrest base 1 and in communication with the guiding groove 11. A pad 14 can be mounted on top of the armrest 1, allowing a user to place his or her elbow on the pad 14.

The support 2 is mounted below the armrest 1. A first restraining plate 211 is formed on a top end of the support 2. In the preferred embodiment shown, the top end of the support 2 includes an annular portion 20 having a compartment 201. The first restraining plate 211 is formed on an inner periphery 202 of the compartment 201, providing the first restraining plate 211 with a firm position.

The engaging member 3 includes a body 31 having a first slider 35 formed on an upper portion of the body 31. The first slider 35 includes two arms 351 slideably abutting the lateral walls 12 of the guiding groove 11. Thus, the first slider 35 can slide relative to the armrest base 1 along the guiding groove 11. The engaging member 3 further includes a first insertion plate 30 that can be inserted to a position below the first restraining plate 211 according to the material resiliency and the insertion angle.

Figure 6:
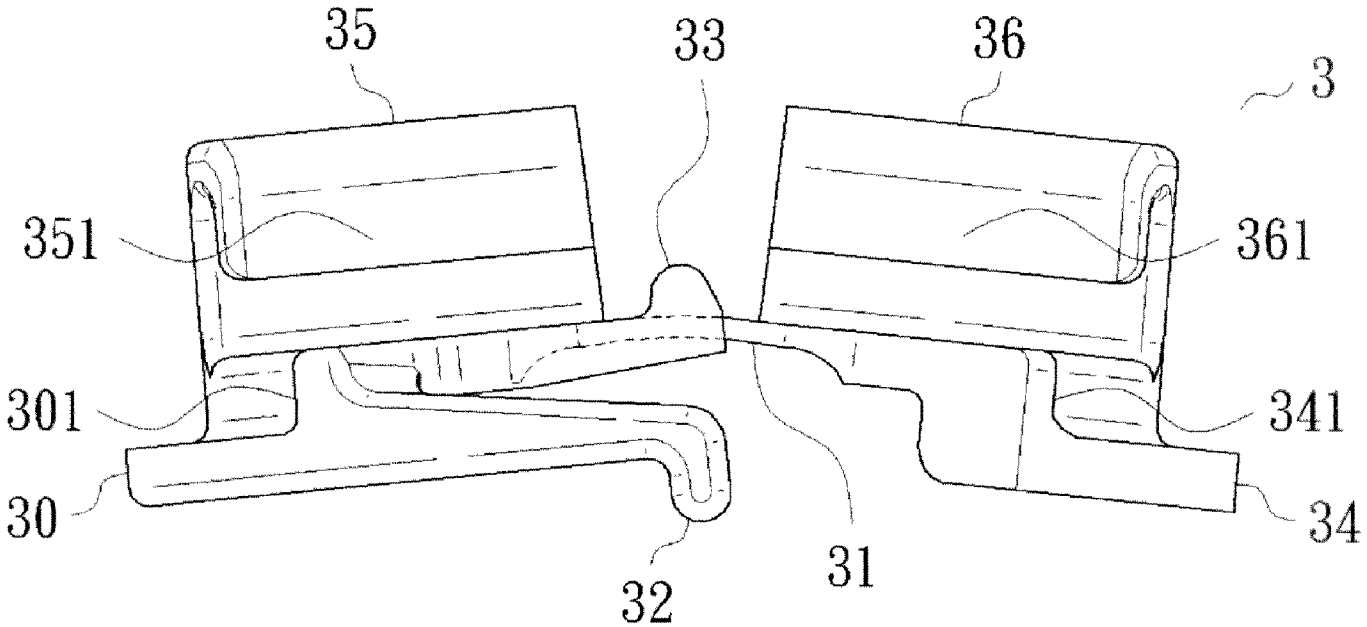
FIG. 6 shows a perspective view of an engaging member, illustrating flexibility of a body of the engaging member.

A second slider 36 can be formed on the upper portion of the body 31 and spaced from the first slider 35. Thus, a gap is formed between the first and second sliders 35 and 36. The gap forms a thin portion in the body 31. The thickness of the thin portion allows the body 31 to flex (see FIG. 6). When the body 31 flexes, the body 31 can be inserted to a position below the first restraining plate 211. The second slider 36 includes two arms 361 slideably abutting the lateral walls 12 of the guiding groove 11, allowing relative sliding movement between the second slider 36 and the armrest base 1 along the guiding groove 11.

The first and second sliders 35 and 36 can be placed into the guiding groove 11 via the opening 13, and the arms 351 and 361 of the first and second sliders 35 and 36 abut the lateral walls 12.

With reference to FIG. 2, the annular portion 20 of the support 2 includes a plurality of annularly spaced teeth 204 in the compartment 201. A groove 203 is formed between two adjacent teeth 204. The engaging member 3 includes a first positioning member 32 projecting downward therefrom. The first positioning member 32 is selectively engaged in one of the grooves 203. Specifically, the first positioning member 32 of engaging member 3 is rotatably received in the compartment 201 and can be engaged with a desired groove 203. Thus, the user can rotate the armrest base 1 relative to the support 2 according to needs.

Figure 3:
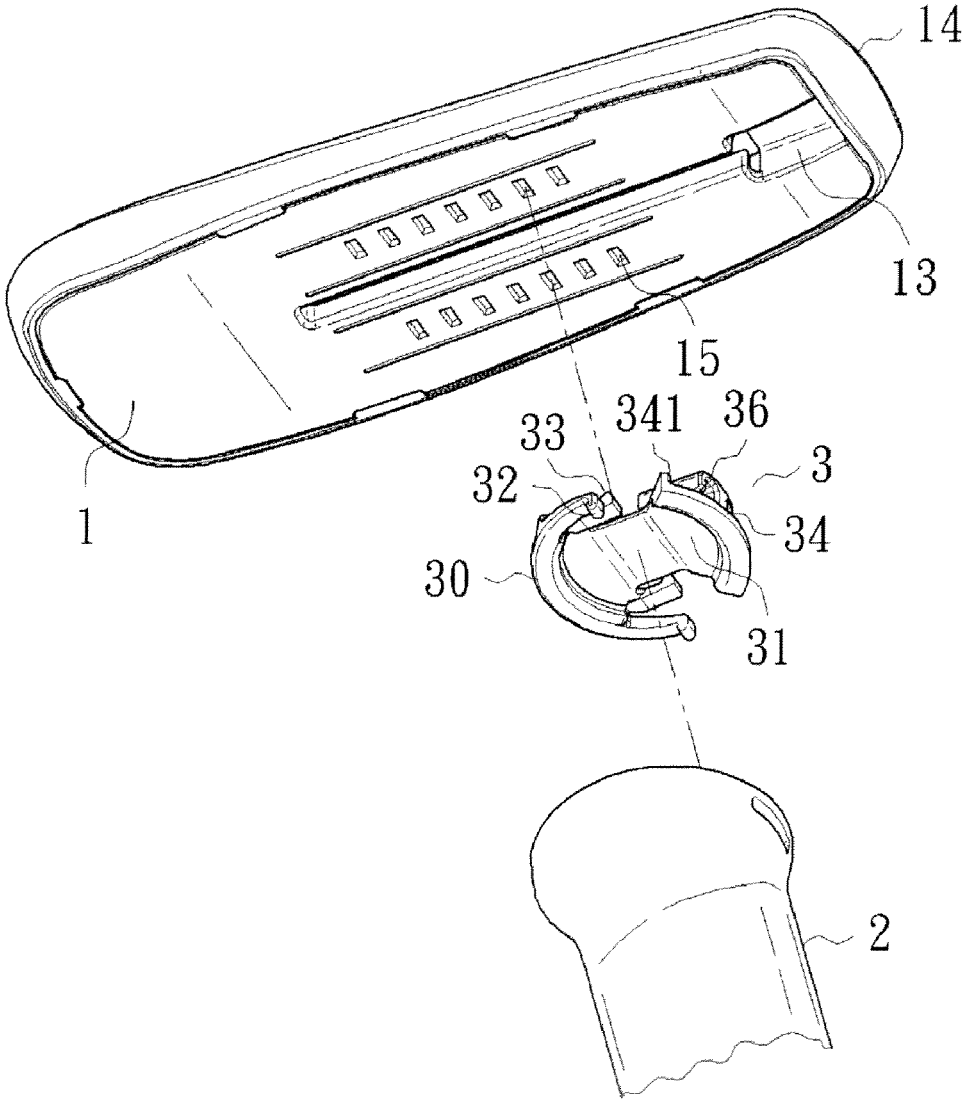
FIG. 3 shows a bottom, exploded, perspective view of the armrest of FIG. 1.

With reference to FIG. 3, the armrest base 1 includes a bottom side having two rows of rectilinearly spaced engaging holes 15. The engaging member 3 includes two second positioning members 33. Each second positioning member 3 is received in one of the engaging holes 15 in one of the two rows. Thus, the armrest 1 can be moved relative the support 2 in a front/rear direction and positioned by the second positioning members 3. However, the armrest base 1 can include only one row of engaging holes 15, and the engaging member 3 can include only one second positioning member 33.

Figure 4:
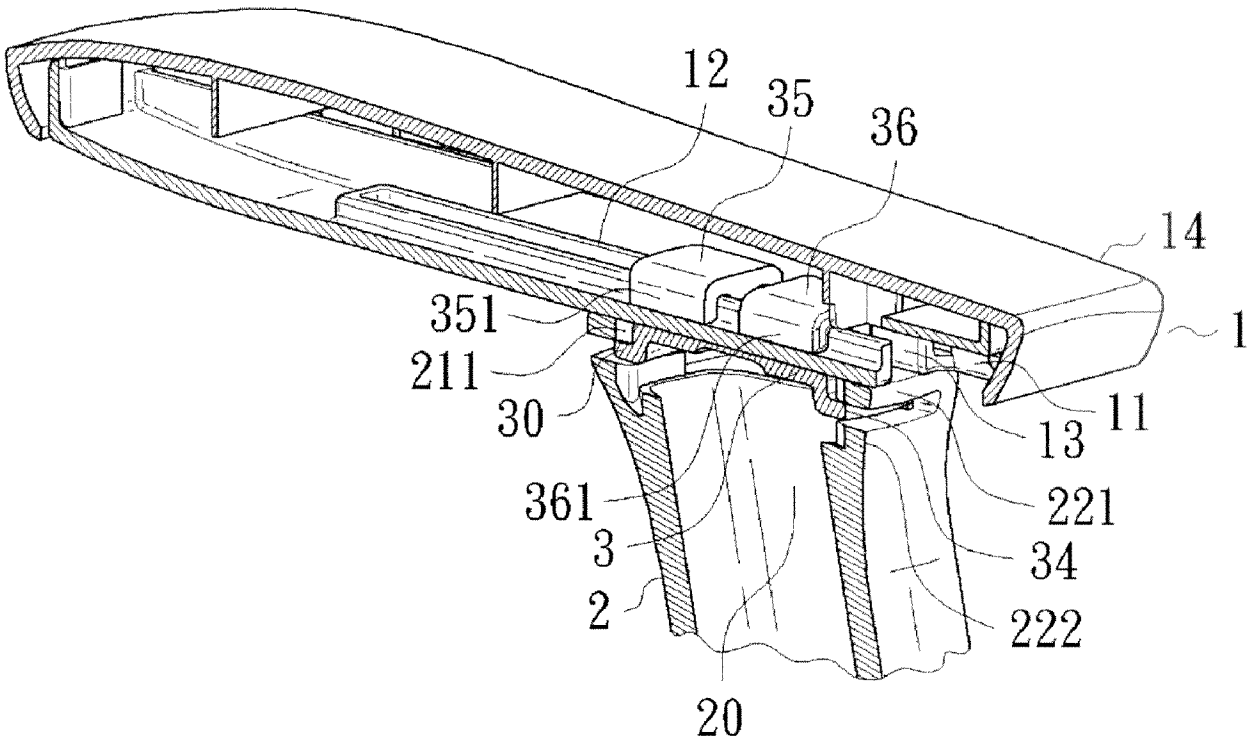
FIG. 4 shows a partial, perspective view of the armrest of FIG. 1 with portions broken away.
Figure 5:
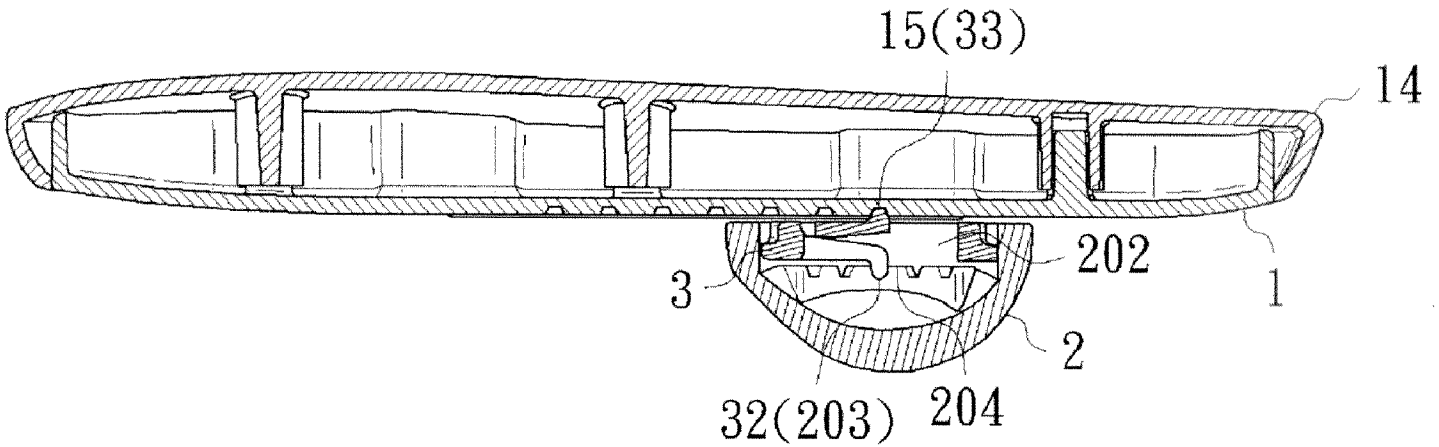
FIG. 5 shows a cross sectional view of the armrest of FIG. 1.

With reference to FIGS. 4 and 5, a second restraining plate 221 can be formed on the inner periphery of the compartment 201 of the annular body 20 and spaced from the first restraining plate 211. The engaging member 3 includes a second insertion plate 34. The second insertion plate 34 can be inserted to a position below the second restraining plate 221 according to the material resiliency and the insertion angle. This arrangement provides firm assembly and disposition of the engaging member 3 and the support 2. Specifically, the body 31 can be inserted to a position below the second restraining plate 221 when the body 31 flexes.

Figure 7:
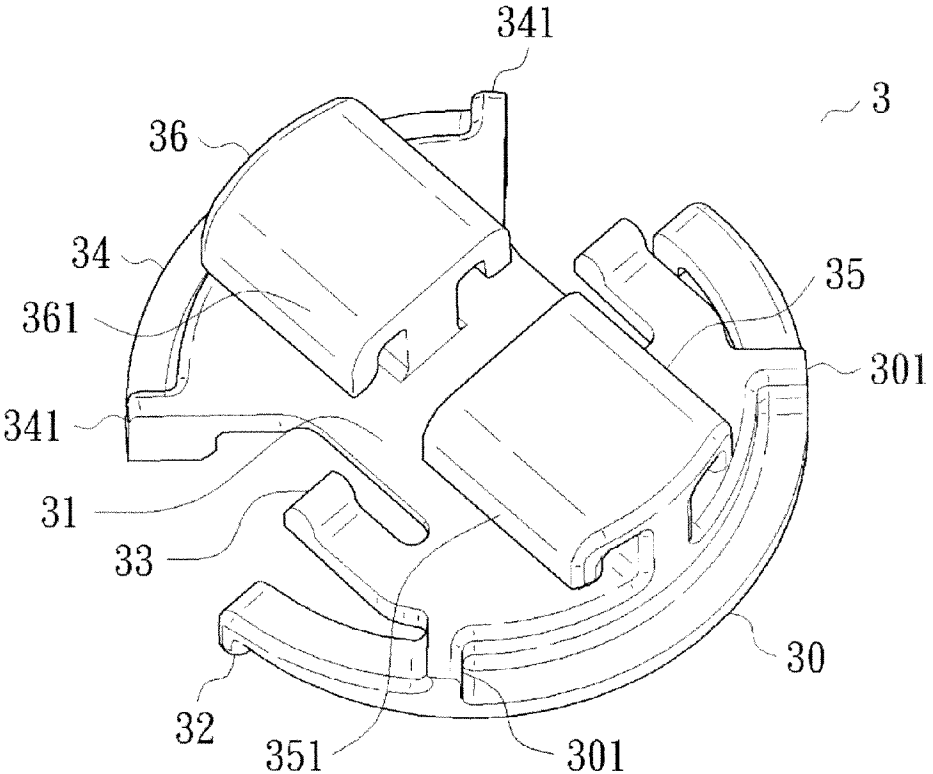
FIG. 7 shows another perspective view of the engaging member of FIG. 6.

With reference to FIGS. 2 and 4, the first insertion plate 30 is arcuate and has a length larger than the first restraining plate 211. A stop 301 (FIG. 7) projects upward from each of two ends of the first insertion plate 30. The stops 301 limit rotational movement of the first insertion plate 30 when the engaging member 3 is rotated.

With reference to FIGS. 2 and 4, the second insertion plate 34 is arcuate and has a length larger than the second restraining plate 221. A stop 341 projects upward from each of two ends of the second insertion plate 34. The stops 341 limit rotational movement of the second insertion plate 34 when the engaging member 3 is rotated.

The armrest base 1 and the support 2 of the armrest according to the present invention can be assembled with a simple mechanism, avoiding complicated assemblage. Thus, labor, time, costs, material, and resources are saved. The wastes to be treated are lesser than conventional armrests when the armrest according to the present invention is discarded.

Although specific embodiments have been illustrated and described, numerous modifications and variations are still possible without departing from the essence of the invention. The scope of the invention is limited by the accompanying claims.

The invention claimed is:

1. An armrest comprising:

an armrest base including a guiding groove having two lateral walls;

a support mounted below the armrest base, with the support including a top end having a first restraining plate, with the top end of the support including an annular portion having a compartment, with the first restraining plate formed on an inner periphery of the compartment; and an engaging member including a body having an upper portion, with a first slider formed on the upper portion of the body, with the first slider including two arms slideably abutting the two lateral walls of the guiding groove, allowing relative sliding movement between the first slider and the armrest base along the guiding groove, with the engaging member further including a first insertion plate located below the first restraining plate, with the engaging member rotatably received in the compartment of the support, with the annular portion of the support including a plurality of annularly spaced teeth in the compartment, with a plurality of grooves having a groove formed between two adjacent teeth, with the engaging member including a first positioning member projecting downwardly therefrom, with the first positioning member selectively engaged in one of the grooves.

2. The armrest as claimed in claim 1, with the armrest including a rear end having an opening, with the opening in communication with the guiding groove.

3. The armrest as claimed in claim 1, with the body further including a second slider formed on the upper portion of the body and spaced from the first slider, with a gap formed between the first and second sliders, with the gap forming a thin portion in the body, with the thin portion of the body having a thickness allowing the body to flex, with the second slider including two arms slideably abutting the lateral walls of the guiding groove, allowing relative sliding movement between the second slider and the armrest base along the guiding groove.

4. The armrest as claimed in claim 1, with the engaging member rotatably received in the compartment of the support, with the first insertion plate being arcuate and having a length larger than the first restraining plate, with a stop projecting upward from each of two ends of the first insertion plate, with the stops of the first insertion plate limiting rotational movement of the first insertion plate.

5. The armrest as claimed in claim 1, with the armrest base including a bottom side having a plurality of rectilinearly spaced engaging holes, with the engaging member including a second positioning member selectively engaged in one of the plurality of engaging holes while the engaging member is moving rectilinearly relative to the support.

6. The armrest as claimed in claim 1, with the annular portion further including a second restraining plate formed on the inner periphery of the compartment and spaced from the first restraining plate, with the engaging member including a second insertion plate, with the second insertion plate located below the second restraining plate, with the first and second insertion plates inserted to positions below the first and second restraining plate according to material resiliency and insertion angles.

7. The armrest as claimed in claim 6, with the engaging member rotatably received in the compartment of the support, with the second insertion plate being arcuate and having a length larger than the second restraining plate, with a stop projecting upward from each of two ends of the second insertion plate, with the stops of the second insertion plate limiting rotational movement of the second insertion plate.

* * * * *